US009771208B2

(12) United States Patent
Chen et al.

(10) Patent No.: US 9,771,208 B2
(45) Date of Patent: Sep. 26, 2017

(54) LIQUID CRYSTAL MODULE PACKAGING BAG

(71) Applicant: Shenzhen China Star Optoelectronics Technology Co., Ltd., Shenzhen, Guangdong (CN)

(72) Inventors: Shihhsiang Chen, Shenzhen (CN); Qianshuang Hu, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 622 days.

(21) Appl. No.: 14/356,360

(22) PCT Filed: Mar. 25, 2014

(86) PCT No.: PCT/CN2014/074052
§ 371 (c)(1),
(2) Date: May 5, 2014

(87) PCT Pub. No.: WO2015/127703
PCT Pub. Date: Sep. 3, 2015

(65) Prior Publication Data

US 2016/0107829 A1 Apr. 21, 2016

(30) Foreign Application Priority Data

Feb. 25, 2014 (CN) ..... 2014 1 0065620

(51) Int. Cl.
*B65D 33/20* (2006.01)
*B65D 85/38* (2006.01)
(Continued)

(52) U.S. Cl.
CPC ..... *B65D 85/38* (2013.01); *B65D 65/38* (2013.01); *B65D 81/03* (2013.01); *B65D 81/051* (2013.01); *B65D 85/48* (2013.01); *B65D 2213/02* (2013.01)

(58) Field of Classification Search
CPC ..... B65D 75/323; B65D 31/10; B65D 33/20; B65D 33/22; H01L 23/60; H01L 23/67396; B31B 19/90
(Continued)

(56) References Cited

U.S. PATENT DOCUMENTS 4,593,736 A * 6/1986 Morita ..... A45C 11/182 150/131
4,915,222 A * 4/1990 Reidinger ..... B65D 81/03 174/377
(Continued)

FOREIGN PATENT DOCUMENTS

CN 201647269 U * 11/2010
CN 102556475 A 7/2012

*Primary Examiner* — King M Chu
(74) *Attorney, Agent, or Firm* — Andrew C. Cheng

(57) ABSTRACT

The present invention provide a liquid crystal module packaging bag, which includes: comprises a front unit (2) positionable on a front side of a liquid crystal module (10) and a rear unit (4) positionable on a rear side of the liquid crystal module (10). The front unit (2) has a thickness greater than a thickness of the rear unit (4). The liquid crystal module packaging bag of the present invention provides a thickened front unit positioned on the front side of the liquid crystal module to effectively protect the liquid crystal module and also to eliminate attaching of aesthetic-texture adhesive tape that is employed in a conventional packaging process, thereby effectively simplifying the packaging process, improving the packaging efficiency, and reducing the packaging cost.

14 Claims, 8 Drawing Sheets

(51) Int. Cl.

| | |
|---|---|
| ***B65D 81/03*** | (2006.01) |
| ***B65D 65/38*** | (2006.01) |
| ***B65D 81/05*** | (2006.01) |
| ***B65D 85/48*** | (2006.01) |

(58) Field of Classification Search
USPC ..... 206/720, 719; 383/62, 210, 84, 85
See application file for complete search history.

(56) References Cited

U.S. PATENT DOCUMENTS

| | | | | |
|---|---|---|---|---|
| 4,988,547 | A * | 1/1991 | Voto, Jr. | B65D 33/20 383/5 |
| 5,097,949 | A * | 3/1992 | Heldwein | B32B 7/02 206/524.2 |
| 5,205,406 | A * | 4/1993 | Bradford | B65D 5/48038 206/721 |
| 7,075,798 | B2 * | 7/2006 | Hendrickson | H05K 9/0043 206/720 |
| 8,479,922 | B2 * | 7/2013 | Kennedy | H04B 15/00 206/720 |
| 2006/0124747 | A1 * | 6/2006 | Rathbun | A45C 11/182 235/486 |
| 2008/0302701 | A1 * | 12/2008 | Lee | G03F 7/70741 206/719 |

* cited by examiner

LIQUID CRYSTAL MODULE PACKAGING BAG

BACKGROUND OF THE INVENTION

1. Field of the Invention

The present invention relates to the field of packaging, and in particular to a liquid crystal module packaging bag.

2. The Related Arts

Liquid crystal displays (LCDs) have a variety of advantages, such as thin device body, low power consumption, and being free of radiation, and are thus of wide applications, such as mobile phones, personal digital assistants (PDAs), digital cameras, computer monitors, and notebook computer screens.

Most of the liquid crystal displays that are currently available in the market are backlighting liquid crystal displays, which comprise an enclosure and a liquid crystal module arranged in the enclosure. Referring to FIG. 1, a conventional liquid crystal module generally comprises a backlight module 100, a liquid crystal display panel 300 arranged above the backlight module 100, and a front bezel 500 arranged on the liquid crystal display panel 300. The backlight module 100, the liquid crystal display panel 300, and the front bezel 500, after having been assembled together, will generally need transportation and warehousing. In this condition, the liquid crystal module must be properly packaged.

Referring to FIG. 2, generally, after a liquid crystal module has been assembled and subjected to quality inspection, the liquid crystal module will be placed in a processing line in which, aesthetic-texture adhesive tapes 150 are applied to attach a protection film 250 to the front bezel at the front side where at least four positions are fixed, respectively an upper left site, an upper right site, a lower left site, and a lower right site. The upper left site is at the location close to an upper end of the front bezel at the left edge; the upper right site is at the location close to an upper end of the front bezel at the right edge; and the tapes of the lower left site and the lower right sites are respectively set at locations that are respectively close to the lower left corner and the lower right corner of the front bezel. Afterwards, an electrostatic bag 350 is fit over the liquid crystal module. The electrostatic bag 350 has a width that is generally greater than a width of the liquid crystal module, whereby when the liquid crystal module is placed in a lower buffering device (not shown), an excessive portion of the width that exceeds the liquid crystal module is folded backward to allow the electrostatic bag 350 to properly enclose and package the liquid crystal module for preventing invasion of external dust. Afterwards, an upper buffering device (not shown) is set and the entire assembly is placed into a packaging box (not shown).

In a liquid crystal television assembling shop, an unpacking process that is exactly opposite to what described above is carried out. In other words, the package is opened first and then the electrostatic bag 350 is removed. The aesthetic-texture tapes are then peeled off for separating the protection film.

Apparently, in such a known process of packaging, operations of attaching aesthetic-texture adhesive tapes and peeling off the aesthetic-texture adhesive tapes are included. These operations of attaching aesthetic-texture adhesive tapes and peeling off the aesthetic-texture adhesive tapes are generally time-consuming operations, which are disadvantageous to increase of manufacturing efficiency, thereby leading to an increased manufacturing cost.

SUMMARY OF THE INVENTION

An object of the present invention is to provide a liquid crystal module packaging bag, which has a simple structure and a reduced cost and is capable of effectively simplifying a packaging process.

To achieve the above object, the present invention provides a liquid crystal module packaging bag, which comprises: a front unit for being positioned on a front side of a liquid crystal module and a rear unit for being positioned on a rear side of the liquid crystal module. The front unit has a thickness that is greater than a thickness of the rear unit.

The front unit has a two-layered structure, which comprises an electrostatic layer and a protection layer. The electrostatic layer and the rear unit are connected to each other along three sides thereof so as to form a bag body that has one side open. The protection layer is arranged to form an outward extension from the rear unit, whereby to package, the liquid crystal module is first placed into the bag body and then the protection layer is folded in a direction toward the electrostatic layer and inserted into the bag body to be located at the front side of the liquid crystal module.

The protection layer has a width that is less than a width of the rear unit.

The protection layer and the rear unit comprise a fold line formed therebetween.

The electrostatic layer and the rear unit are made of an anti-static material. The anti-static material is polyethylene terephthalate, high-density polyethylene, low-density polyethylene, or a composite material of high-density polyethylene and a polyethylene foam material.

The protection layer is integrally formed with the rear unit and the electrostatic layer.

The protection layer is made of a polyethylene foam material.

The front unit has a single-layer structure.

The front unit is made of polyethylene terephthalate, high-density polyethylene, or low-density polyethylene.

The front unit is made of a composite material of high-density polyethylene and a polyethylene foam material.

The present invention also provides a liquid crystal module packaging bag, which comprises: a front unit for being positioned on a front side of a liquid crystal module and a rear unit for being positioned on a rear side of the liquid crystal module, the front unit having a thickness that is greater than a thickness of the rear unit;

wherein the front unit has a two-layered structure, which comprises an electrostatic layer and a protection layer, the electrostatic layer and the rear unit being connected to each other along three sides thereof so as to form a bag body that has one side open, the protection layer being arranged to form an outward extension from the rear unit, whereby to package, the liquid crystal module is first placed into the bag body and then the protection layer is folded in a direction toward the electrostatic layer and inserted into the bag body to be located at the front side of the liquid crystal module; and wherein the protection layer has a width that is less than a width of the rear unit.

The protection layer and the rear unit comprise a fold line formed therebetween.

The electrostatic layer and the rear unit are made of an anti-static material, the anti-static material being polyethylene terephthalate, high-density polyethylene, low-density polyethylene, or a composite material of high-density polyethylene and a polyethylene foam material.

The protection layer is integrally formed with the rear unit and the electrostatic layer.

The protection layer is made of a polyethylene foam material.

The efficacy of the present invention is that the present invention provides a liquid crystal module packaging bag, in which a front unit that is positioned on a front side of the liquid crystal module is thickened to effectively protect the liquid crystal module and also to eliminate attaching of aesthetic-texture adhesive tape that is employed in a conventional packaging process, thereby effectively simplifying the packaging process, improving the packaging efficiency, and reducing the packaging cost.

For better understanding of the features and technical contents of the present invention, reference will be made to the following detailed description of the present invention and the attached drawings. However, the drawings are provided for the purposes of reference and illustration and are not intended to impose limitations to the present invention.

BRIEF DESCRIPTION OF THE DRAWINGS

The technical solution, as well as other beneficial advantages, of the present invention will be apparent from the following detailed description of embodiments of the present invention, with reference to the attached drawing. In the drawing.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
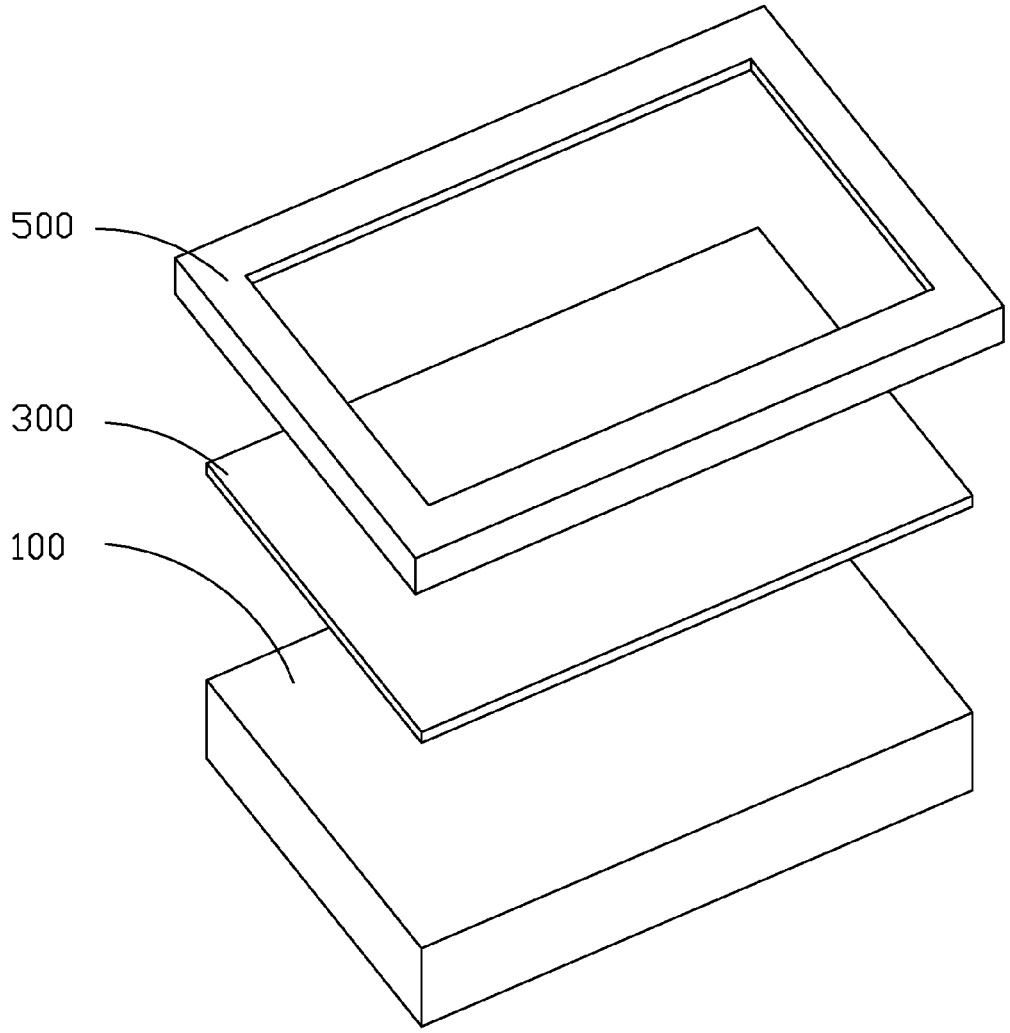
FIG. 1 is an exploded view showing a conventional liquid crystal module.
Figure 2:
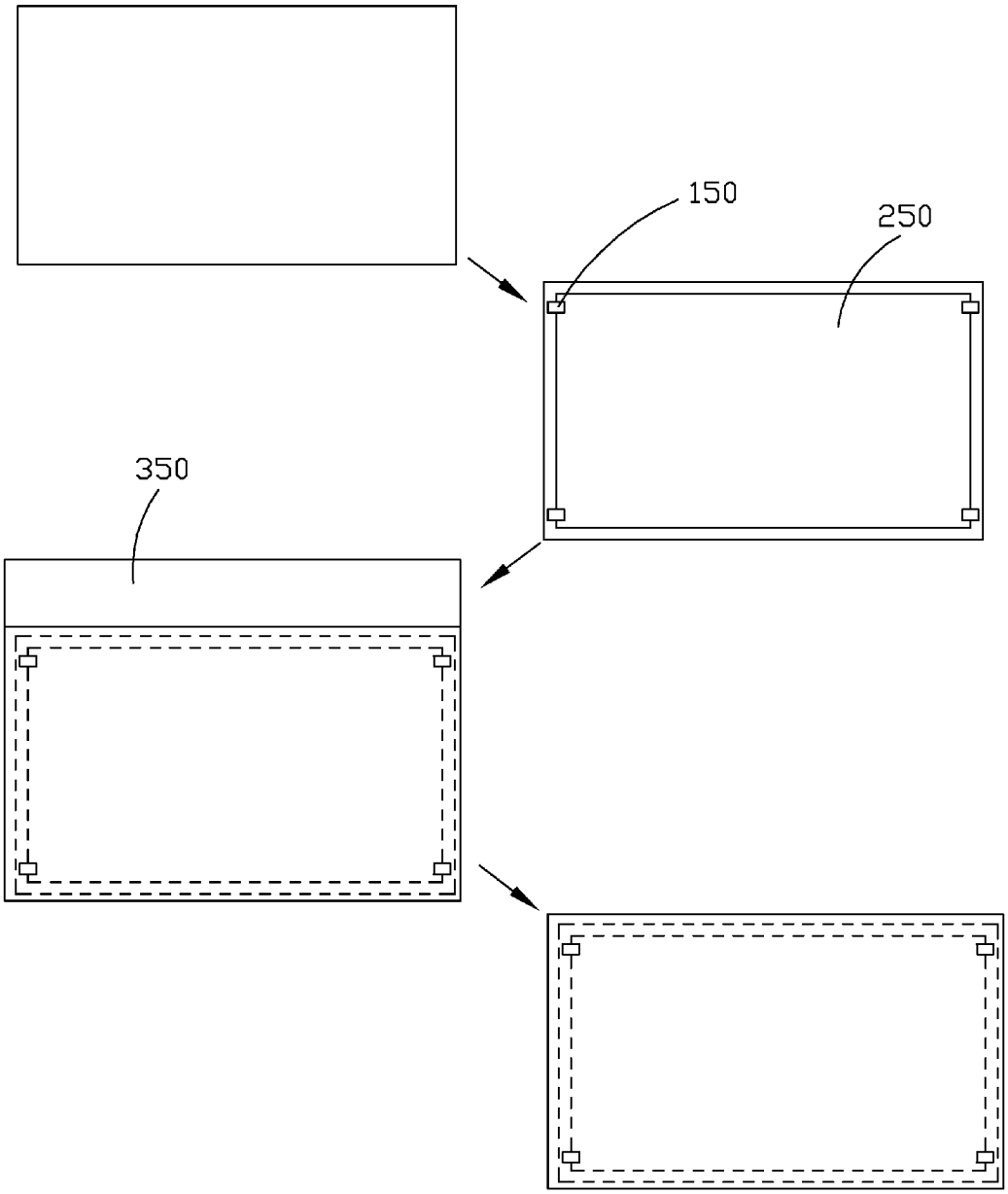
FIG. 2 is a schematic view illustrating a known process of packaging a liquid crystal module.
Figure 3:
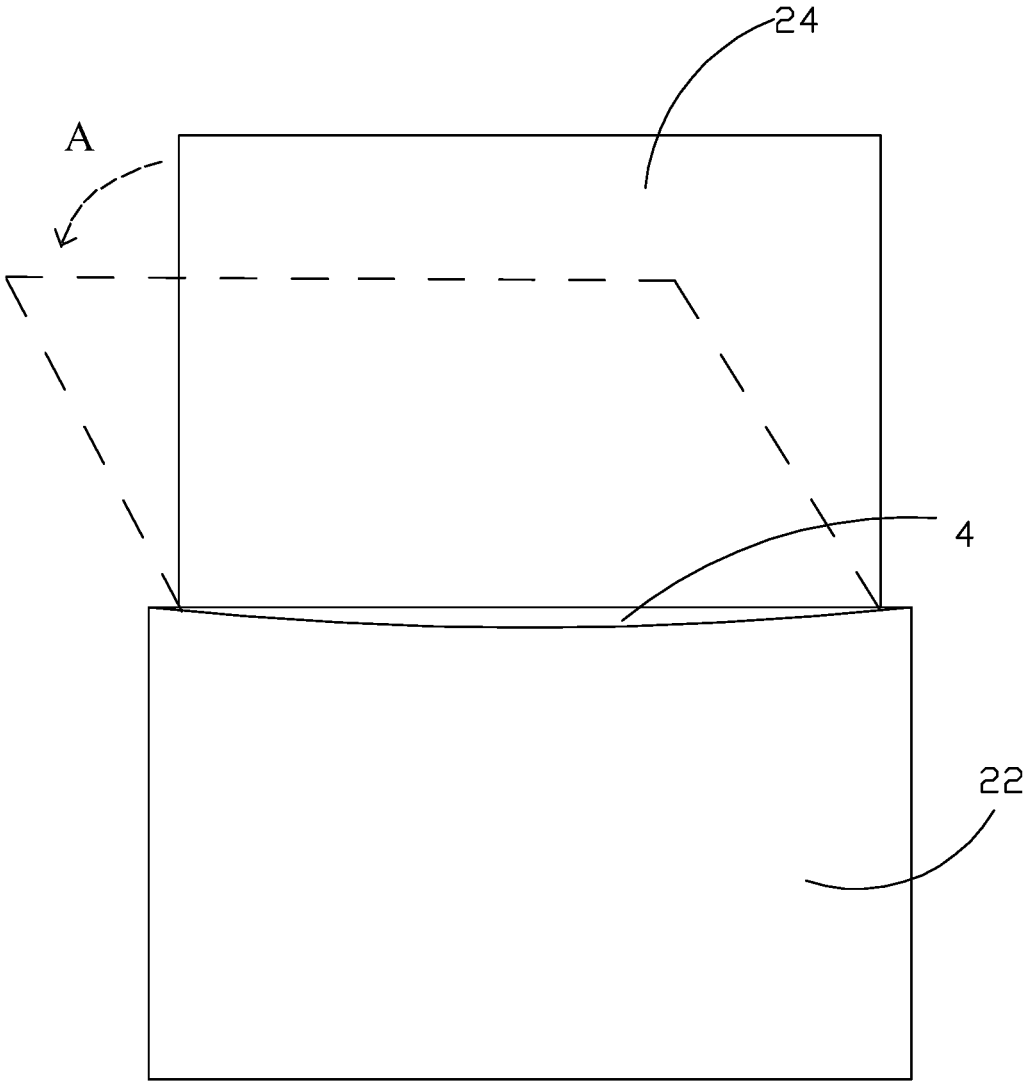
FIG. 3 is a schematic view showing the structure of a liquid crystal module packaging bag according to an embodiment of the present invention.
Figure 4:
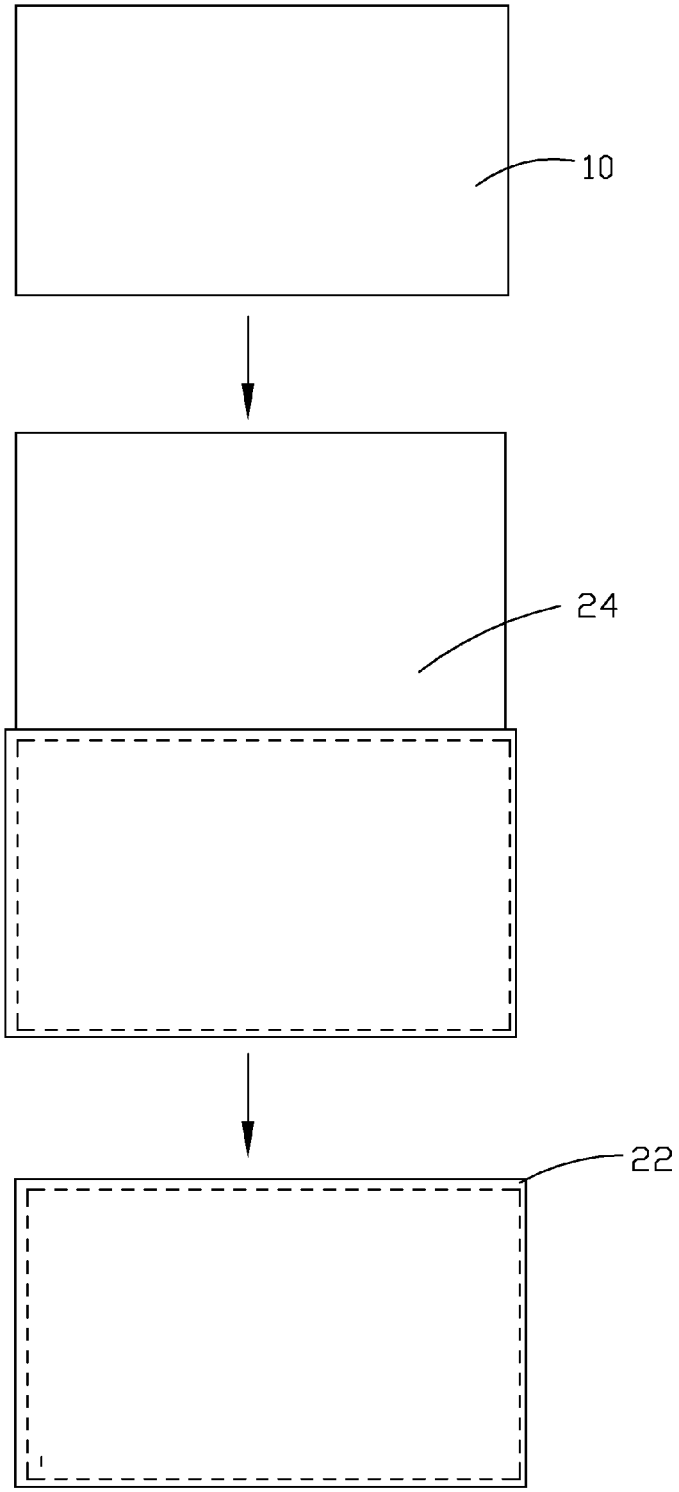
FIG. 4 is a schematic view illustrating a process of packaging a liquid crystal module with a liquid crystal module packaging bag according to the present invention.
Figure 5:
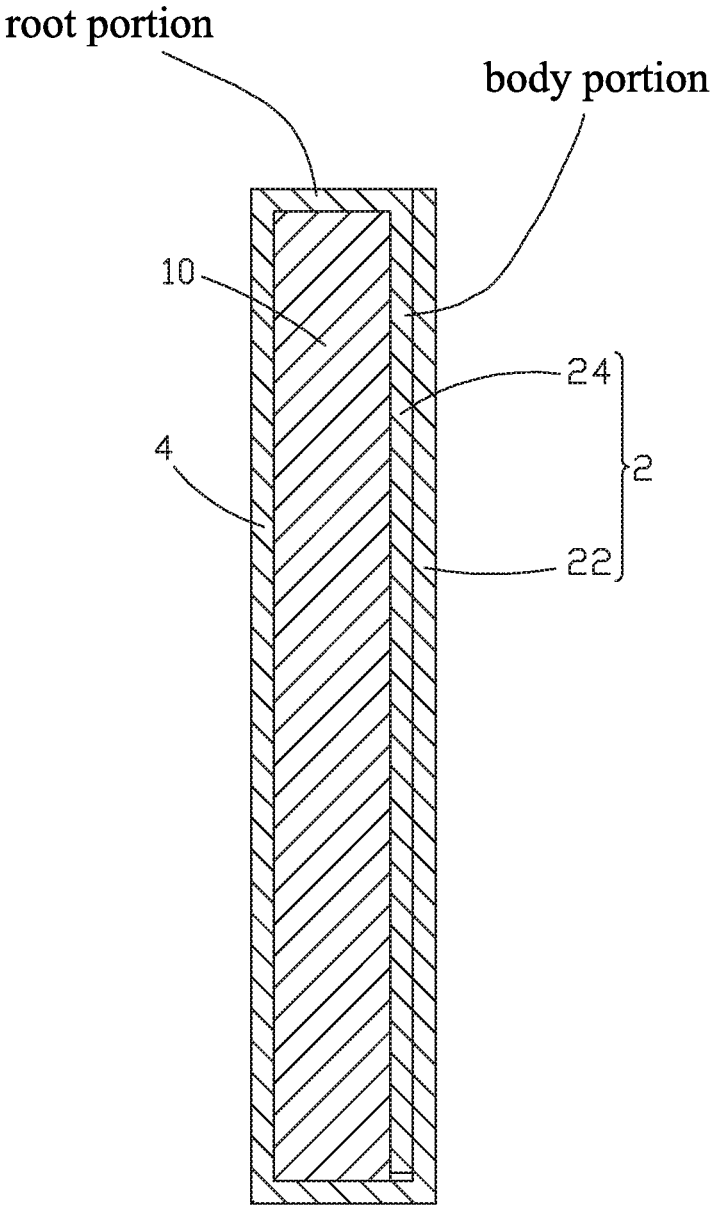
FIG. 5 is a cross-sectional view showing a liquid crystal module that has been packaged with a liquid crystal module packaging bag according to the present invention.

Referring to FIGS. 3-5, the present invention provide a liquid crystal module packaging bag, which comprises: a front unit 2 positionable on a front side of a liquid crystal module 10 and a rear unit 4 positionable on a rear side of the liquid crystal module 10. The front unit 2 has a thickness that is greater than a thickness of the rear unit 4. The liquid crystal module packaging bag according to the present invention provides effective protection of the liquid crystal module 10 by thickening the front unit 2 positioned on the front side of the liquid crystal module 10 and also allows for eliminating an operation of attaching aesthetic-texture adhesive tapes employed in a conventional packaging process so as to effectively simplify the packaging process, improve the packaging efficiency, and reduce the packaging cost.

Specifically, referring to FIG. 5, in the instant embodiment, the front unit 2 has a two-layered structure, which comprises an electrostatic layer 22 and a protection layer 24. The electrostatic layer 22 and the rear unit 4 are connected to each other along three sides thereof so as to form a bag body that has one side open. The protection layer 24 is arranged to form an outward extension from the rear unit 4. To package, the liquid crystal module 10 is first placed into the bag body. Then, the protection layer 24 is folded in a direction, as indicated by arrow A in FIG. 3 (in which phantom lines are provided to illustrate a partially folded condition of the protection layer), toward the electrostatic layer 22 and inserted into the bag body to be located at the front side of the liquid crystal module 10. As such, a two-layer structure is formed at the front side of the liquid crystal module 10, one of the layers being the protection layer 24 that extends from the rear unit 4 and the other being the electrostatic layer 22 so as to prevent the generation of static electricity and thus protecting the liquid crystal module 10 from being damaged by the static electricity, while providing effective cushioning to the liquid crystal module 10.

Further, in the instant embodiment, the protection layer 24 has a width that is less than a width of the rear unit 4 in order to allow for easy insertion of the protection layer 24 into the bag body and also for easy withdrawal of the protection layer 24 out of the bag body, thereby effectively increasing packaging efficiency and unpacking efficiency.

Figure 6:
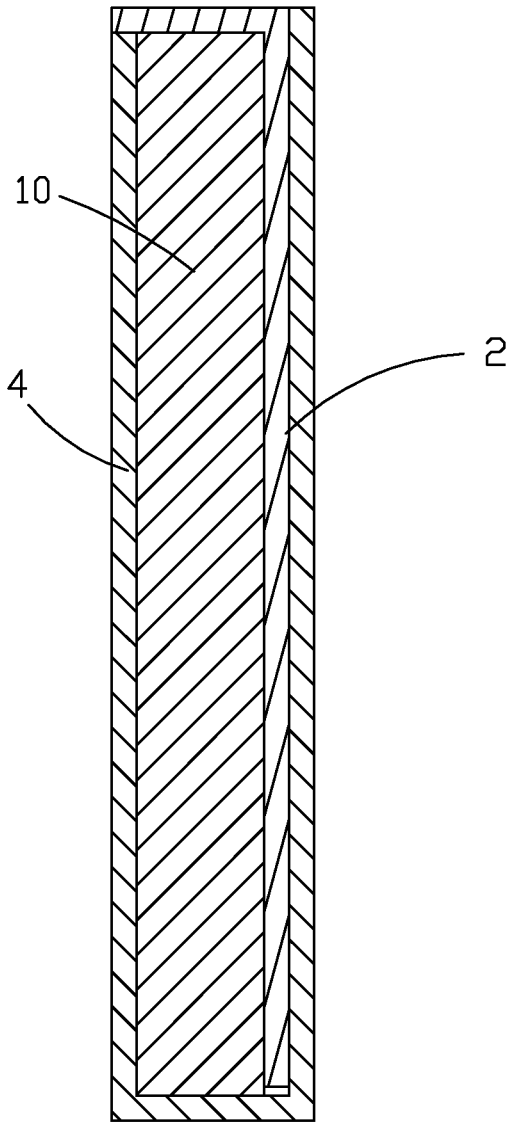
FIG. 6 is another cross-sectional view showing a liquid crystal module that has been packaged with a liquid crystal module packaging bag according to the present invention.

In the instant embodiment, the rear unit 4 and the electrostatic layer 22 are integrally formed together with the same material, preferably an antic-static material, which can be polyethylene terephthalate (PET), high-density polyethylene (HDPE), low-density polyethylene (LDPE), or composite materials of high-density polyethylene and polyethylene (PE) foam materials. The protection layer 24 can be integrally formed with the rear unit 4 and the electrostatic layer 22 with an anti-static material or can alternatively be made of a polyethylene foam material (as shown in FIG. 6), all being effective to achieve a technical advantage of increasing packaging efficiency according to the present invention.

Figure 7:
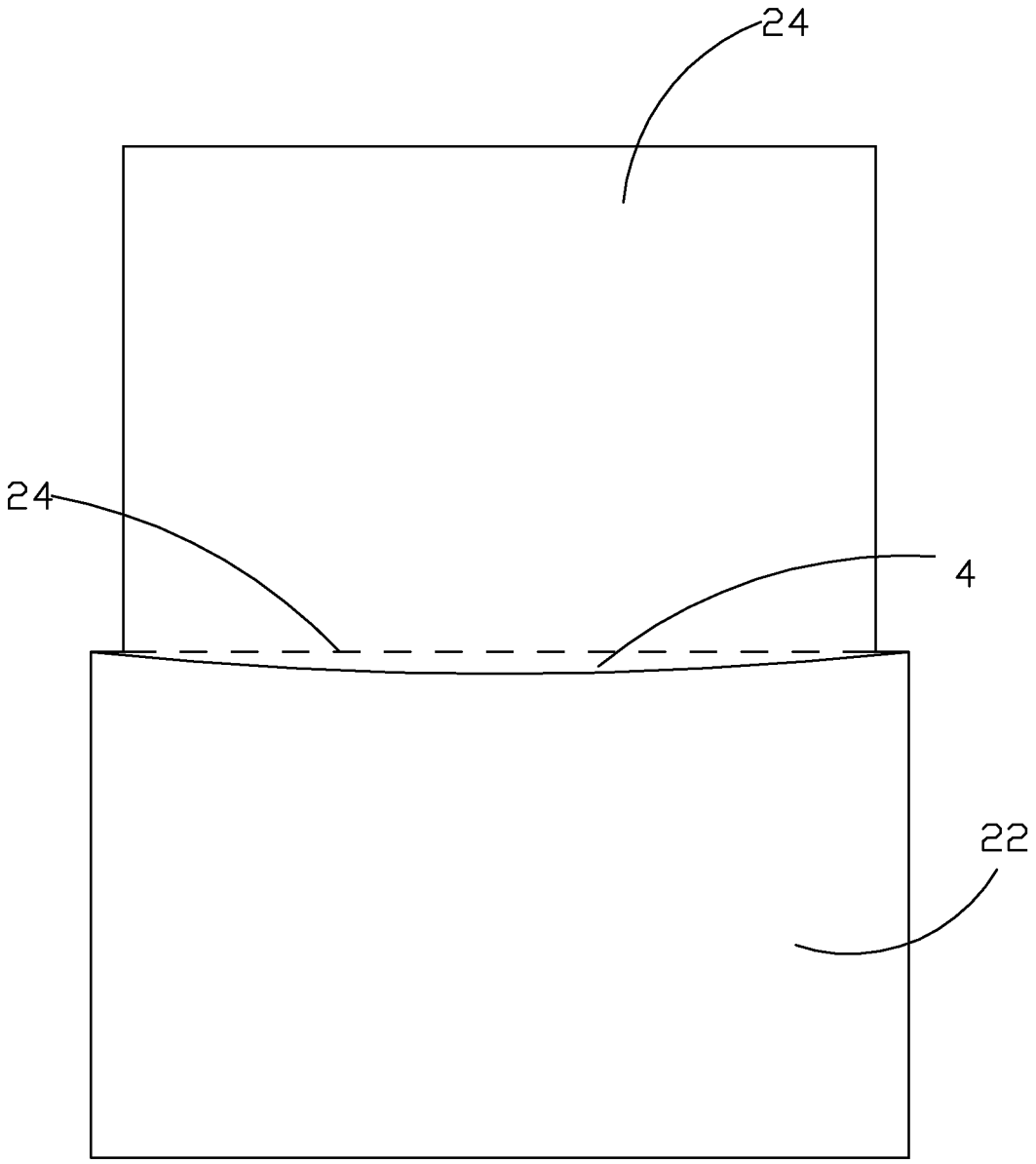
FIG. 7 is a schematic view showing the structure of a liquid crystal module packaging bag according to another embodiment of the present invention.

Referring to FIG. 7, which is a schematic view showing the structure of a liquid crystal module packaging bag according to a second embodiment of the present invention, in the instant embodiment, a fold line 244 is formed between the protection layer 24 and the rear unit 4. The fold line 244 can be of a serrated form or a floss form to enable easy folding of the protection layer 24 thereby further improving the packaging efficiency.

Figure 8:
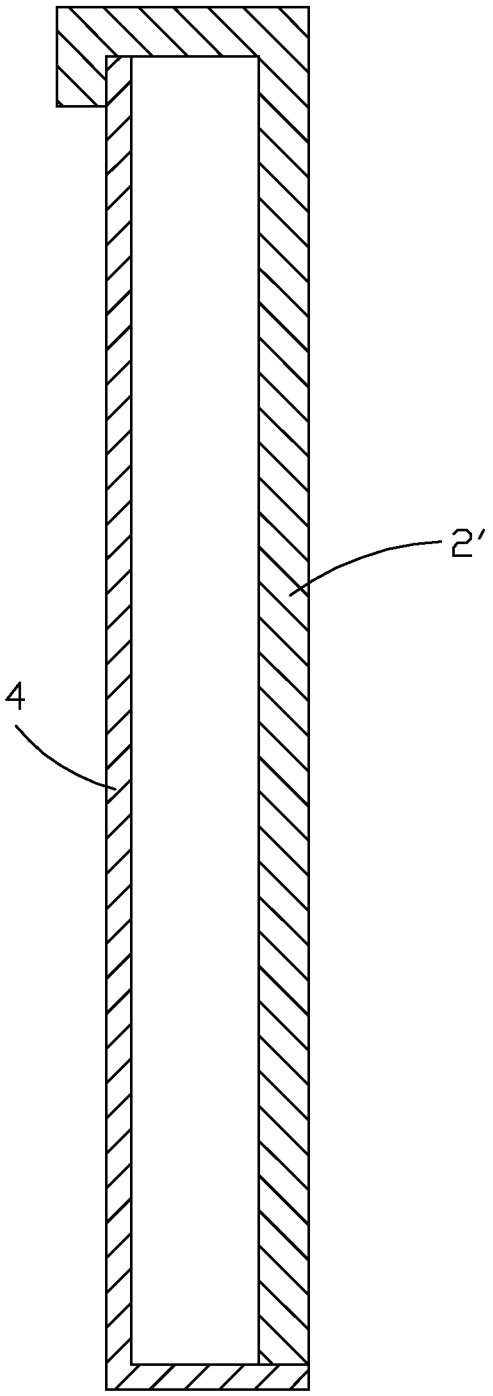
FIG. 8 is a cross-sectional view showing the structure of a liquid crystal module packaging bag according to a further embodiment of the present invention.

Referring to FIG. 8, which is a cross-sectional view showing the structure of a liquid crystal module packaging bag according to a third embodiment of the present invention, in the instant embodiment, the front unit 2' has a single-layer structure. The front unit 2' can be made of polyethylene terephthalate, high-density polyethylene, or low-density polyethylene, or be alternatively made of a composite material of high-density polyethylene and a polyethylene foam material. In manufacturing, the front unit 2' is made to have a thickness greater than the rear unit 4.

To package, the liquid crystal module is first placed in the bag body. A portion of the front unit 2' that exceeds the liquid crystal module is folded towards the rear unit 4 to complete the packaging operation.

The present invention provides a liquid crystal module packaging bag, in which a front unit that is positioned on a front side of the liquid crystal module is thickened to effectively protect the liquid crystal module and also to eliminate attaching of aesthetic-texture adhesive tape that is employed in a conventional packaging process, thereby effectively simplifying the packaging process, improving the packaging efficiency, and reducing the packaging cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A liquid crystal module packaging bag, comprising: a front unit for being positioned on a front side of a liquid crystal module and a rear unit for being positioned on a rear side of the liquid crystal module, the front unit having a thickness that is greater than a thickness of the rear unit;

wherein the front unit comprises an electrostatic layer that has four sides of which first, second, and third sides are respectively connected to first, second, and third sides of the rear unit to form a bag body such that a fourth side of the electrostatic layer and a fourth side of the rear unit are arranged to correspond to each other and are not connected to each other to form an opening therebetween, serving as an open side of the bag body and adapted to receive a liquid crystal module therethrough into the bag body, a protection layer having a root portion connected to and extending outward from the fourth side of the rear unit and a body portion extending from the root portion and exhibiting flexibility for folding and movable between an outside position where the body portion is located outside the bag body to keep the opening of the open side in a wide open condition for receiving the liquid crystal module to insert into the bag body and an inside position where the body portion is folded and inserted through the opening of the open side of the bag body into an interior of the bag body to be located between the electrostatic layer of the front unit and the liquid crystal module to constitute, in combination with the electrostatic layer, a two-layered structure of the front unit such that a first surface of the protection layer is kept in direct surface contact with the liquid crystal module and an opposite second surface of the protection layer is in direct surface contact with the electrostatic layer of the front unit to form the two-layered structure.

2. The liquid crystal module packaging bag as claimed in claim 1, wherein the protection layer has a width that is less than a width of the rear unit.

3. The liquid crystal module packaging bag as claimed in claim 1, wherein the protection layer and the rear unit comprise a fold line formed therebetween.

4. The liquid crystal module packaging bag as claimed in claim 1, wherein the electrostatic layer and the rear unit are made of an anti-static material, the anti-static material being polyethylene terephthalate, high-density polyethylene, low-density polyethylene, or a composite material of high-density polyethylene and a polyethylene foam material.

5. The liquid crystal module packaging bag as claimed in claim 4, wherein the protection layer is integrally formed with the rear unit and the electrostatic layer.

6. The liquid crystal module packaging bag as claimed in claim 4, wherein the protection layer is made of a polyethylene foam material.

7. A liquid crystal module packaging, comprising: a front unit for being positioned on a front side of a liquid crystal module and a rear unit for being positioned on a rear side of the liquid crystal module, wherein the front unit has a single-layer structure, the single layer of the front unit having a first thickness that is greater than a second thickness of the rear unit;

wherein the single layer of the front unit has four sides of which first, second, and third sides are respectively connected to first, second, and third sides of the rear unit to form a bag body such that a fourth side of the single layer of the front unit and a fourth side of the rear unit are arranged to correspond to each other and the fourth side of the single layer of the front unit and the fourth side of the rear unit are not connected to each other to form an opening therebetween, serving as an open side of the bag body and adapted to receive a liquid crystal module therethrough into the bag body, wherein a distal portion of the fourth sides of the single layer of the front unit extends beyond the fourth side of the rear unit and is foldable over the fourth side of the rear unit to be positioned against an outside surface of the rear unit, and wherein a portion of the single layer of the front unit that has the first thickness that is greater than the second thickness of the rear unit is opposite to the rear unit such that the liquid crystal module is received between the portion of the single layer of the front unit and the rear unit, wherein the portion of the single layer of the front unit that has the first thickness is in contact with one side of the liquid crystal module, while the rear unit that has the second thickness is in contact with an opposite side of the liquid crystal module, the liquid crystal module being sandwiched between the first thickness and the second thickness.

8. The liquid crystal module packaging bag as claimed in claim 7, wherein the front unit is made of polyethylene terephthalate, high-density polyethylene, or low-density polyethylene.

9. The liquid crystal module packaging bag as claimed in claim 7, wherein the front unit is made of a composite material of high-density polyethylene and a polyethylene foam material.

10. A liquid crystal module packaging bag, comprising: a front unit for being positioned on a front side of a liquid crystal module and a rear unit for being positioned on a rear side of the liquid crystal module, the front unit having a thickness that is greater than a thickness of the rear unit;

wherein the front unit comprises an electrostatic layer that has four sides of which first, second, and third sides are respectively connected to first, second, and third sides of the rear unit to form a bag body such that a fourth side of the electrostatic layer and a fourth side of the rear unit are arranged to correspond to each other and are not connected to each other to form an opening therebetween, serving as an open side of the bag body and adapted to receive a liquid crystal module therethrough into the bag body, a protection layer having a root portion connected to and extending outward from the fourth side of the rear unit and a body portion extending from the root portion and exhibiting flexibility for folding and movable between an outside position where the body portion is located outside the bag body to keep the opening of the open side in a wide open condition for receiving the liquid crystal module to insert into the bag body and an inside position where the body portion is folded and inserted through the opening of the open side of the bag body into an interior of the bag body to be located between the electrostatic layer of the front unit and the liquid crystal module to constitute, in combination with the electrostatic layer, a two-layered structure of the front unit such that a first surface of the protection layer is kept in direct surface contact with the liquid crystal module and an opposite second surface of the protection layer is in direct surface contact with the electrostatic layer of the front unit to form the two-layered structure; and wherein the protection layer has a width that is less than a width of the rear unit.

11. The liquid crystal module packaging bag as claimed in claim 10, wherein the protection layer and the rear unit comprise a fold line formed therebetween.

12. The liquid crystal module packaging bag as claimed in claim 10, wherein the electrostatic layer and the rear unit are made of an anti-static material, the anti-static material being polyethylene terephthalate, high-density polyethylene, low-density polyethylene, or a composite material of high-density polyethylene and a polyethylene foam material.

13. The liquid crystal module packaging bag as claimed in claim 12, wherein the protection layer is integrally formed with the rear unit and the electrostatic layer.

14. The liquid crystal module packaging bag as claimed in claim 12, wherein the protection layer is made of a polyethylene foam material.

* * * * *